US005644985A

United States Patent [19]

Serain et al.

[11] Patent Number: 5,644,985

[45] Date of Patent: Jul. 8, 1997

[54] PRINTING BLANKET AND PRINTING CYLINDER FITTED WITH THIS BLANKET

[75] Inventors: Hugues Serain, Wattwiller; Denis Hertzog, Bevrwiller, both of France

[73] Assignee: Rollin S.A., France

[21] Appl. No.: 414,512

[22] Filed: Mar. 31, 1995

[30] Foreign Application Priority Data

Mar. 31, 1994 [FR] France ..... 94 03849

[51] Int. Cl.[6] ..... B41F 21/00

[52] U.S. Cl. ..... 101/415.1; 101/401.1

[58] Field of Search ..... 428/909; 101/415.1, 101/401.1, 395

[56] References Cited

U.S. PATENT DOCUMENTS

| | | | |
|---|---|---|---|
| 4,093,487 | 6/1978 | Gaworowski et al. | 428/909 |
| 4,093,764 | 6/1978 | Duckett et al. | 428/909 |
| 4,337,700 | 7/1982 | Etchell et al. | 101/415.1 |
| 4,421,826 | 12/1983 | Ohlson et al. | 428/394 |
| 4,599,943 | 7/1986 | Kobler | 101/217 |
| 5,069,958 | 12/1991 | Burns | 428/909 |
| 5,102,107 | 4/1992 | Simon et al. | 267/152 |
| 5,121,832 | 6/1992 | Fiocchi | 206/3 |
| 5,295,436 | 3/1994 | Kittsteiner et al. | 101/415.1 |
| 5,350,623 | 9/1994 | Derrick | 428/909 |

FOREIGN PATENT DOCUMENTS

| | | | |
|---|---|---|---|
| 0248695 | 8/1987 | Germany | 101/415.1 |

*Primary Examiner*—Edgar S. Burr
*Assistant Examiner*—Anthony H. Nguyen
*Attorney, Agent, or Firm*—Woodcock Washburn Kurtz Mackiewicz & Norris

[57] ABSTRACT

The present invention relates to an improved printing blanket as well as to a printing cylinder fitted with this blanket.

This printing blanket essentially comprises a lithographic or printing layer, a compressible layer, an external reinforcing fabric layer, and a layer of polymeric material extending over substantially the whole surface of the reinforcing layer and closely connected to the latter so as to form an integral part of the blanket.

This blanket may be mounted in a tight manner onto cylinders for machines for printing newspapers and the like.

17 Claims, 2 Drawing Sheets

PRINTING BLANKET AND PRINTING CYLINDER FITTED WITH THIS BLANKET

FIELD OF THE INVENTION

The present invention has essentially as its subject a printing blanket which may be used in printing machines of various types.

It is also directed to a printing cylinder fitted with this blanket.

BACKGROUND OF THE INVENTION

It is well known that printing blankets generally comprise a lithographic layer with which is associated at least one compressible layer and one reinforcing layer.

These blankets are generally fastened with two opposite edges into an axial gap formed in a cylinder so as to surround the cylinder in a tight fashion.

Onto the cylinder is generally stuck a dressing sheet or layer the opposite edges of which are interrupted substantially plumb with the side walls of the gap in the cylinder so that the blanket surrounds this dressing sheet while being quite simply applied thereupon.

Such an arrangement raises many problems.

Indeed, in the course of time, i.e., after a substantial working of the rotary cylinders, there occurs a relating sliding of the blanket with respect to the subjacent dressing, thereby resulting in a creeping and an unsticking of the dressing. Thus a wear of the blanket occurs at the level of its ingress into the gap of the cylinder, which wear frequently leads to a break of the blanket which becomes unusable and has to be replaced. Moreover, the creeping or unsticking of the dressing sheet or layer may permit the infiltration of moisture and therefore may cause a corrosion on the periphery of the printing cylinder.

In this respect, it should be noted that the conventional blankets the base layer of which is a fabric layer and which are applied directly onto the printing cylinder absorb the moisture and cause corrosion phenomena on the peripheral surface of the cylinder.

OBJECTS OF THE INVENTION

Therefore the present invention has as its object to solve all the hereabove problems by proposing an integral printing blanket constituting a perfect fluid-tightness barrier with respect to the cylinder which it surrounds and suppressing any possible break phenomenon at the level of its portion penetrating into the gap of the printing cylinder.

SUMMARY OF THE INVENTION

The invention presents a printing cylinder comprising a lithographic or printing layer with which is associated at least one compressible layer and an external reinforcing layer and on both opposite edges of which may be exerted a pull for fastening it onto a printing cylinder in an axial gap formed in this cylinder, characterized in that onto the external layer opposite to the lithographic layer is fastened a layer of polymeric material extending substantially over the whole surface of the said external layer and forming an integral part of the blanket.

One should specify here that the layer of polymeric material is fastened onto the aforesaid external layer of the blanket by sticking, extrusion, hot complexing, coating or calendering.

This printing blanket is further characterized in that the thickness of the layer of polymeric material is comprised between about 4 and 400 microns whereas the blanket proper has a thickness comprised between about 1 and 3 min.

According to a preferred embodiment, the thickness of the layer of polymeric material is comprised between 100 and 250 microns whereas the thickness of the blanket is comprised between 1.6 and 2.1 mm.

It should also be specified here that the layer of polymeric material may be made from a thermoplastic elastomer such for example as urethane, from a thermoplastic copolymer of polyester and of polyether, from polyolefin, from polyamide, from block-polymers of styrene or from alloys of thermoplastic materials either containing or not containing non-thermoplastic phases.

The blanket according to this invention is further characterized by the fact that the external surface of the layer of polymeric material comprises raised portions, which may offer advantages from the standpoint of compressibility.

The layer of polymeric material may also consist of an alveolate material making this layer compressible and impervious to water and to the fluids associated with printing.

The invention is also directed to a printing cylinder fitted with a blanket meeting the hereabove characteristics. The printing cylinder comprises an internal axial gap with means for fastening, with adjustment, the two opposite edges of the blanket so that it tightly surrounds the periphery of the cylinder, characterized in that both opposite edges of the blanket together with its integrated layer of polymeric material penetrate into the gap of the cylinders down at least to the level of the fastening means of the cylinders.

These fastening means are for gripping the opposite edges of the blanket, whether or not the blanket comprises the layer of polymeric material.

According to another characteristic of this printing cylinder in the case where the layer of polymeric material is gripped by the fastening means, it constitutes by itself a means for retaining through sticking of the aforesaid opposite edges onto the said fastening means.

Thus owing to the fact that the layer of polymeric material and blanket together form a unitary assembly, the fastening about the cylinder through a pull upon the opposite edges of this unitary assembly will not only be outstanding but will advantageously avoid any problem of infiltration of moisture risking to corrode the periphery of the cylinder.

But further advantages and characteristics of the invention will appear better in the detailed description which follows and refers to the attached drawings given by way of example only.

Figure 1:
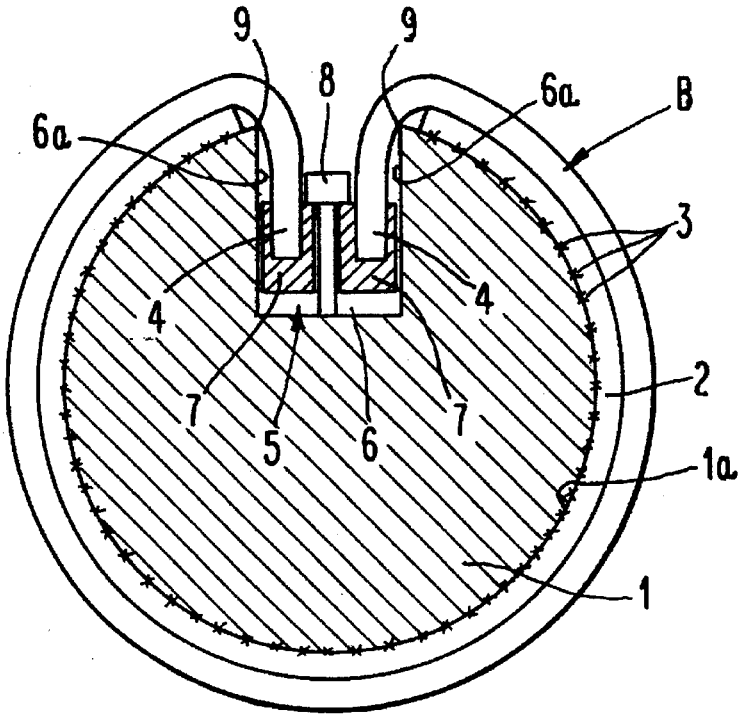
PRIOR ART Fig. 1
FIG. 1 is a diagrammatic view in cross-section of a printing cylinder about which is fastened a blanket according to the techniques of the prior art.

On FIG. 1, one sees a printing cylinder 1 surrounded in a tight fashion by a blanket according to the prior art.

More specifically, a dressing 2 is adhered and therefore fastened permanently onto the external surface 1*a* of the cylinder 1, this previous adhering or fastening of the dressing 2 being physically shown by the small crosses designated at 3. And one has designated at B a blanket which is quite merely applied onto the dressing layer 2 and the free ends 4 of which are gripped by fastening means 5 accommodated within a gap 6 extending axially and formed in the cylinder 1 as one sees it well on FIG. 1.

The fastening means 5 generally comprise two metal bars 7 each one receiving the end 4 of the blanket B and which may be radially actuated by an element 8 constituting for example a screw system and adapted to exert a pull upon the ends 4 of the blanket B in order that it applies in a tight manner onto the dressing 2 made fast to the printing cylinder 1.

The dressing 2 is interrupted substantially at the level of the side walls 6*a* of the gap 6 whereas only the ends 4 of the blanket B may be gripped by the bars 7 after they have penetrated into the gap 6 and cleared the sharp angle 9 constituted by the connection of the side walls 6*a* of the gap 6 to the external surface 1*a* of the printing cylinder 1.

The hereabove arrangements are well known and exhibit the inconveniences mentioned at the beginning of this description.

In short, a relative slipping of the blanket B with respect to the dressing 2 may occur and it results therefrom of course a wear at the level of at least the said blanket. Moreover at the level of the sharp angle 9, there often occurs in the course of time a break of the blanket B, which may make it unusable and requires its replacement. In addition under the effect of the relative slipping, the dressing 2 may be damaged and separate somewhat from the external surface 1*a* of the cylinder 1, so that the moisture may reach the surface 1*a* and cause corrosions there. This is frequent in the printing of the newspapers which as one knows is carried out according to a printing process requiring more water. It should also be remarked that if the blanket B is replaced with a new blanket and if the dressing 2 is damaged, the quality of the printing effected by the blanket will necessarily be altered.

Figure 2A:
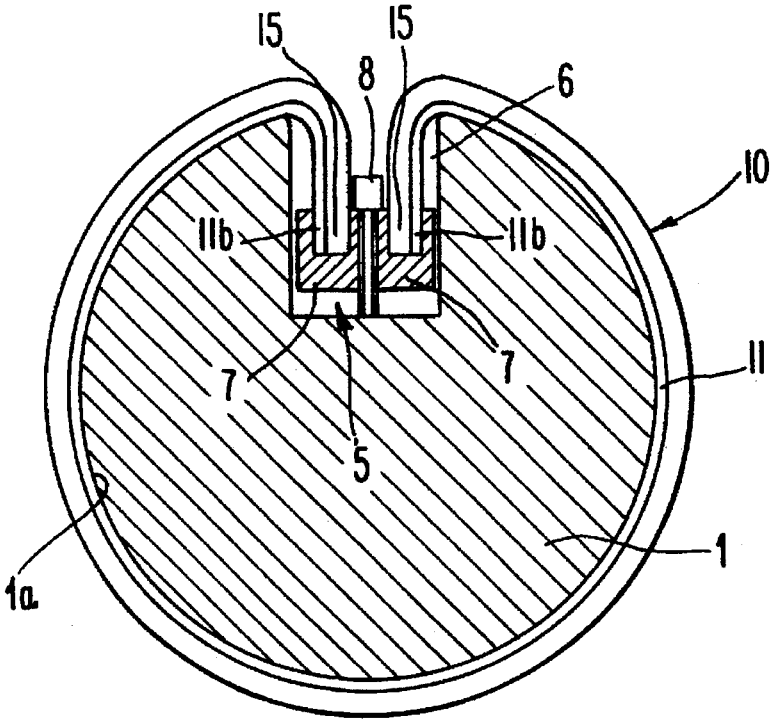
FIG. 2 is a view similar to FIG. 1 but illustrating the blanket according to this invention in the position fastened onto a printing cylinder.
Figure 2B:
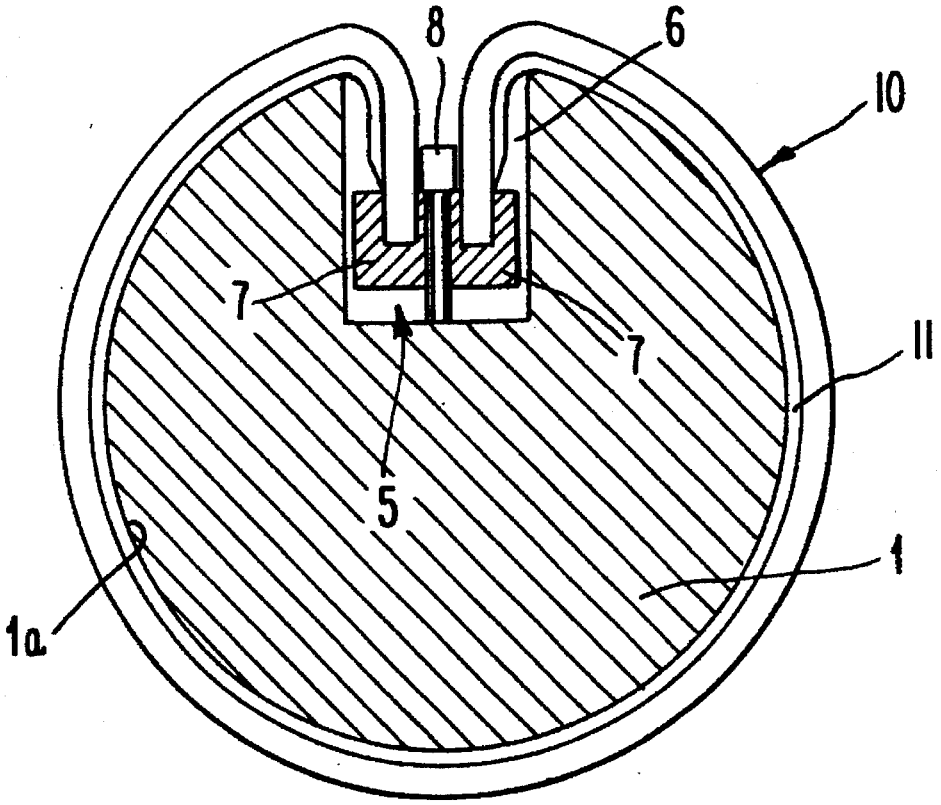

According to the invention, which solves all the above-identified problems, the cylinder 1 as one sees it on FIG. 2 is covered with a blanket 10 to which is closely fastened a layer 11 of polymeric material which extends over substantially the whole surface of the blanket 10. Otherwise said, the layer 11 of polymeric material forms an integral part of the blanket 10 and constitutes a unitary assembly which will quite simply be applied upon the external surface 1*a* of the cylinder 1 and will be tightened over the periphery of this surface by the fastening means 5.

Figure 3:
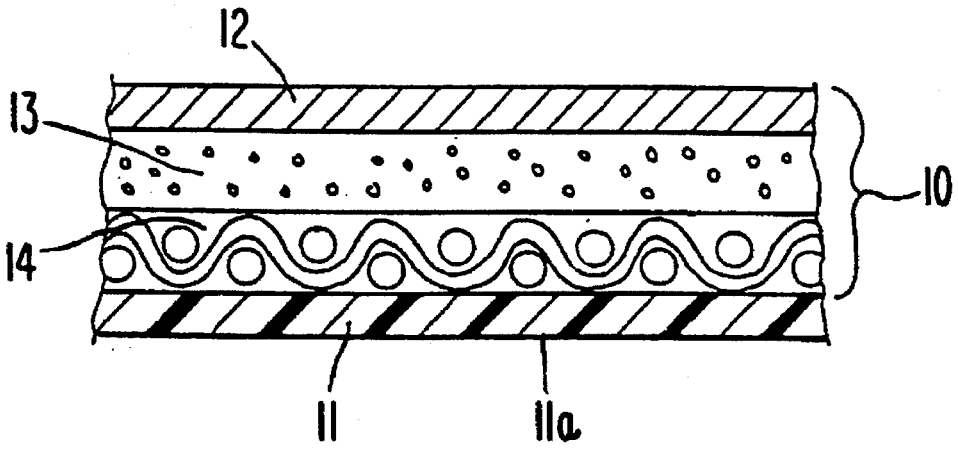
FIG. 3 is a diagrammatic view of a cross-section of an exemplary embodiment of a printing blanket according to this invention.

According to the exemplary embodiment illustrated by FIG. 3, the blanket 10 comprises a lithographic or printing layer 12, a compressible layer 13 of cellular rubber and a reinforcing fabric layer 14 to which is closely connected the layer 11 of polymeric material.

This layer 11 may be connected to the reinforcing fabric layer 14 by any suitable means known per se, for example by adhesive bonding, extrusion, hot complexing, coating or calendering.

Thus, polymeric material issuing from an extruder (not shown) at a temperature between about 120° to 240° C. could pass between two cylinders at the same time as the blanket 10 so as to obtain downstream of both cylinders the unitary assembly shown on FIG. 3.

According to another examplary embodiment, this unitary assembly could be obtained through hot laminating at a temperature between 120° and 240° C., this hot laminating consisting in passing a sheet of polymeric material such as 11 and a blanket such as 10 between two rotary cylinders (not shown) at a temperature in the aforesaid range.

The thickness of the layer of polymeric material 11 will be between about 4 and 400 microns and preferably between 100 and 250 microns whereas the thickness of the blanket 10 will be between about 1 and 3 mm and preferably between 1.6 and 2.1 mm.

As a polymeric material for the layer 11, one may use various materials such for example as a thermoplastic elastomer of the urethane type, a thermoplastic copolymer of polyester and of polyether, a polyolefin, a polyamide, block-polymers of styrene such as SB, SBS, SIS, SEB-S, ASA or alloys of thermoplastic phases (or ranges). As examples of such alloys, one may cite mixtures of polymers PP, PE, PS, ABS, PC, SAN, PA with thermoplastic elastomers of the type IIR, EPDM, NR, SBR, EVA and silicones. The properties may be improved by compatibilization or dynamic vulcanization.

As a polymeric material for the layer 11, one may further cite: polyurethanes, copolymers of polyamide and of polyether, trans polyisoprene, thermoplastic 1,2-polybutadiene, polyethylene ethylene vinyl acetate or ethylene ethyl acetate, PVF, PVDF, PA or PVDC, copolymers of polysulfone and polymethylsiloxane, copolymers of polystyrene and polymethylsiloxane and copolymers of silicone, of polysulfone and of polymethylsiloxane. But other materials could perfectly be used without leaving the scope of the invention.

One should however preferably use a material of the thermoplastic elastomer type which may be cross-linked through irradiation or a non thermoplastic elastomer material cross-linked through heat or through irradiation.

One should of course not use polymers risking to cause a corrosion of the cylinders (for example in the case of the presence of ionic chlorine) as well as polymers which are not chemically resistant to water or are swelling in the presence of water.

Although this has not been shown in FIG. 3, the layer of polymeric material 11 could comprise on its external face 11*a* which will quite simply be applied upon the external surface 1*a* of the cylinder 1, raised portions likely to improve the compressibility of the laminate illustrated on FIG. 3 and this laminate may if one desires it, comprise additional layers not shown.

The layer 11 could also be formed of an alveolate polymeric material, i.e., a material comprising closed cells obtained for example with the assistance of processes known per se such as the use of swelling agents or the incorporation of microballs. Therefore the layer 11 will be compressible while remaining impervious essentially to water and to the fluids associated with the printing of the newspapers for example.

Thus the laminate which has just been described, when it will be mounted and locked onto the cylinder 1, as one sees it well on FIG. 2, will raise no problem of slipping in relation to the blanket 10 with respect to the layer of polymeric material 11 in view of the close connection by any suitable means of the said layer to the blanket 10.

On FIG. 2, one sees that both opposite and free edges 15 of the blanket 10 together with its integrated layer 11 of polymeric material penetrate into the gap 6 and this so that they may be made fast to the fastening means 5.

More specifically the layer 11 extends over the whole surface of the blanket 10, i.e., over the whole surface of the reinforcing fabric layer 14, so that the ends 11*b* of the layer 11 are themselves also fastened into the bars 7. The fastening onto the bars may be carried out by profiting by the presence of the ends 11*b* of the layer 11 which under the effect of the heat could provide a sticking of the unitary blanket 10-layer 11 assembly onto the bars 7.

But one could perfectly without leaving the scope of the invention proceed in such a way that the layer 11 does not extend to the edges of the ends 15 of the blanket 10, i.e. the ends 11*b* of the layer 11 would be located somewhat outside of the bars 7. In this case, only the opposite edges 15 of the blanket 10 will be fastened mechanically or by adhesive bonding for example onto the bars 7.

But it is quite sure that in both cases, a pull effected by the element 8 on the opposite edges of the unitary laminate shown on FIG. 3 will provide a homogeneous tensioning of the said unitary laminate so as to tighten it about the cylinder 1 which may be a hollow or solid metal cylinder.

One has thus provided according to the invention a printing blanket which owing to the integration of a layer of polymeric material into the blanket proper exhibits the many following advantages.

A homogenous tensioning without any relative slipping of the layers is exerted upon the blanket when one applies it and one tightens it onto the cylinder through a pull on its opposite edges. Likewise the layer of polymeric material makes the blanket impervious with respect to the cylinder onto which it is applied, thereby avoiding any phenomenon of corrosion of the said cylinder (in particular in the case of a cylinder for the printing of newspapers) and also any variation in the thickness of the blanket. In addition the blanket will withstand the folding at the level of the gap of the cylinder and any break will be avoided in that area. Moreover, when the printing cylinder is in operation, i.e., co-operates through pressure with another cylinder, there will occur no slipping of the layers with respect to each other and therefore no creeping phenomenon likely to result in printing defects since once more the base layer of polymeric material which is merely applied and tightened onto the cylinder is integral with the blanket proper and the tensioning for tightening is uniformly distributed over the whole length of the unitary assembly or laminate covering the said cylinder.

It should be understood that the invention is not at all limited to the embodiment described and illustrated which has been given by way of example only.

Thus the blanket may comprise intermediate layers in addition to those described and illustrated. Likewise the polymeric material constituting the layer integrated into the blanket and applying itself onto the printing cylinder may be made from any suitable material.

This means that the invention comprises all the technical equivalents of the means described as well as their combinations if the latter are carried out according to its gist.

We claim:

1. An improved printing blanket for placement around a printing cylinder, said printing cylinder having an axial gap for receiving opposite ends of the printing blanket, said blanket comprising a printing layer, a compressible layer beneath the printing layer, and an outer reinforcing layer adjacent to the compressible layer, wherein the improvement comprises a layer of polymeric material fastened to the surface of the reinforcing layer opposite the compressible layer and extending over substantially all of said surface of the reinforcing layer.

2. A blanket according to claim 1 wherein the layer of polymeric material is fastened onto the reinforcing layer of the blanket through sticking, extrusion, hot complexing, coating, or calendering.

3. A blanket according to claims 1 or 2 wherein said layer of polymeric material has a thickness of between about 4 and 400 microns, and said printing blanket has a thickness of between about 1–3 mm.

4. A blanket according to claim 2 wherein said layer of polymeric material has a thickness of between 100 and 250 microns and said printing blanket has a thickness of between about 1.6 and 2.1 mm.

5. A blanket according to claims 1, 2 or 4 wherein the layer of polymeric material comprises a thermoplastic elastomeric material, alloys of thermoplastic materials, or alloys of thermoplastic materials containing non-thermoplastic phases.

6. A blanket according to claim 5 wherein the thermoplastic elastomeric material is selected from the group consisting of a urethane polymer, a copolymer of polyester and polyether, a polyolefin, a polyamide, and a styrene block co-polymer.

7. A blanket according to claims 1, 2, or 4 wherein the external surface of the layer of polymeric material comprises raised portions.

8. A blanket according to claim 6 wherein the external surface of the layer of polymeric material comprises raised portions.

9. A blanket according to claims 1, 2, or 4 wherein the layer of polymeric material comprises an alveolate material.

10. A blanket according to claim 8 wherein the layer of polymeric material comprises an alveolate material.

11. A printing cylinder fitted with a blanket according to claims 1, 2, or 4, said cylinder comprising an axially extending gap adapted to receive opposite ends of the blanket, and means within the gap for fastening the opposite edges of the blanket such that the blanket tightly surrounds the periphery of the cylinder, wherein both opposite edges of the blanket penetrate into the gap at least to the fastening means.

12. A cylinder according to claim 11 wherein the polymeric layer of the blanket does not extend over the portions of the ends of the blanket that penetrate into the gap to the fastening means.

13. A cylinder according to claim 11 wherein the polymeric layer extends over the portions of the ends of the blanket that penetrate into the gap.

14. A cylinder according to claim 13 wherein the fastening means secures the blanket by gripping the polymeric layer.

15. A printing cylinder fitted with an improved printing blanket, said cylinder comprising an axially extending gap adapted to receive opposite ends of the blanket, and means within the gap for fastening the opposite edges of the blanket such that the blanket tightly surrounds the periphery of the cylinder, wherein both opposite edges of the blanket penetrate into the gap at least to the fastening means, wherein said blanket comprises a printing layer, a compressible layer beneath the printing layer, and an outer reinforcing layer adjacent to the compressible layer, wherein the improvement comprises a layer of polymeric material fastened to the surface of the reinforcing layer opposite the compressible layer and extending over substantially all of said surface of the reinforcing layer, wherein said polymeric layer has a thickness between about 100 and 250 microns and comprises a thermoplastic elastomeric material selected from the group consisting of a urethane polymer, a copolymer of polyester and polyether, a polyolefin, a polyamide, and a styrene block co-polymer; alloys of thermoplastic materials; or alloys of thermoplastic materials containing non-thermoplastic phases; and wherein the total thickness of the printing, compressible, and reinforcing layers is between about 1.6 and 2.1 mm.

16. The printing cylinder of claim 15 wherein the external surface of the layer of polymeric material comprises raised portions.

17. The printing cylinder of claim 15 wherein the external surface of the layer of polymeric material comprises an alveolate material.

* * * * *

UNITED STATES PATENT AND TRADEMARK OFFICE

CERTIFICATE OF CORRECTION

PATENT NO. : 5,644,985

DATED : July 8, 1997

INVENTOR(S) : Hugues Serain and Denis Hertzog

It is certified that error appears in the above-indentified patent and that said Letters Patent is hereby corrected as shown below:

Column 2, line 3; "min" should read -- mm --.

Signed and Sealed this

Eighteenth Day of November 1997

*Attest:*

Bruce Lehman

BRUCE LEHMAN

*Attesting Officer*

*Commissioner of Patents and Trademarks*